United States Patent [19]

Richter

[11] 4,196,103

[45] Apr. 1, 1980

[54] COLORED DETERGENTS

[75] Inventor: Virgil J. Richter, West Orange, N.J.

[73] Assignee: Colgate-Palmolive Company, New York, N.Y.

[21] Appl. No.: 631,590

[22] Filed: Nov. 13, 1975

Related U.S. Application Data

[63] Continuation of Ser. No. 440,786, Feb. 8, 1974, abandoned, which is a continuation of Ser. No. 154,692, Jun. 18, 1971, abandoned.

[51] Int. Cl.[2] ..... C11D 1/02; C11D 1/94

[52] U.S. Cl. ..... 252/541; 252/526; 252/540; 252/DIG. 15

[58] Field of Search ..... 252/541, 526, 89, 540, 252/DIG. 8, 15; 8/41 R; 260/141

[56] References Cited

U.S. PATENT DOCUMENTS

| | | | |
|---|---|---|---|
| 3,157,633 | 11/1964 | Kuhn | 260/200 |
| 3,519,054 | 7/1970 | Cavataio et al. | 252/137 X |

FOREIGN PATENT DOCUMENTS

| | | |
|---|---|---|
| 577479 | 6/1959 | Canada . |
| 1248994 | 10/1971 | United Kingdom . |

*Primary Examiner*—Thomas J. Herbert, Jr.
*Attorney, Agent, or Firm*—Norman Blumenkopf; Herbert S. Sylvester; Murray M. Grill

[57] ABSTRACT

A multi-colored particulate detergent with over 80% of the particles in the 6 to 200 mesh range and consisting essentially of 5 to 30% detergent, 10 to 50% builder and 2 to 13% water and from 0.1 to 20% of the composition of a colored particulate component in the 6 to 140 mesh range and consisting essentially of a builder salt provided with azo dye coating including a polymeric material.

4 Claims, No Drawings

COLORED DETERGENTS

This is a continuation, of application Ser. No. 440,786 filed Feb. 8, 1974, now abandoned, which in turn is a continuation of Ser. No. 154,692, filed June 18, 1971, now abandoned.

Colored detergents are manufactured commercially in large quantities for aesthetic reasons and to specifically identify some of the many brands and formulas of detergents on the market. Although white detergent particles and clear detergent solutions have long been the standard articles of commerce, in recent years the consumer has shown a preference for various attractively colored products, including detergents, and as a result, many colored, speckled, mixed-colored or variegated detergent products have been sold. In some cases, particular functional materials have been included in the formulations and sometimes these have been concentrated in the colored particles, so that the coloring serves to identify the formulation containing such a material. In other instances, brand identification is reinforced by the utilization of colored detergent particles.

Generally, the small proportion of dye in the ultimate detergent solution is insufficient to color materials being washed and dye stains are not a serious problem. However, it has been noted that certain materials, which may be exceptionally substantive to some dyes, have been discolored during the washing process or take on a colored cast after repeated washings with the same detergent product and contacts with the dyes contained therein. Especially in those instances wherein concentrated solutions or pastes of colored detergents are applied to fibrous materials, such as textiles, laundry, animal, vegetable and synthetic fibers or human hair, objectionable coloring can result. Therefore, efforts have been made to discover detergent compositions and dyes for coloring them which, even when subjected to adverse conditions, as when applied in concentrated form to a normally reactive substrate, will not result in objectionable coloration of the substrate. The present detergent compositions, colored with fugitive dyes of the type described herein, allow for the manufacture of attractively colored detergents and do not stain fibrous materials washed with them.

In accordance with the present invention there is provided a detergent composition comprising a synthetic organic detergent selected from the group consisting of anionic and nonionic detergents colored with a fugitive dye of the formula

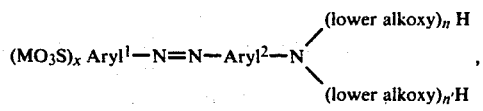

wherein M is a salt forming cation, the aryl groups are carbocylic and contain from 6 to 10 carbon atoms in the ring(s), x is from 1 to 4 and n and n' are from 15 to 75, or a mixture of such dyes. In the usual detergent compositions, from 0.1 to 20% of the particles thereof, which will be of a size to pass through a No. 6 U.S. Standard Sieve Series sieve and be retained by a Number 140 sieve, will be surface coated with a composition containing a sufficient amount of the dye to give it distinctive coloration. Despite the presence of the dye in the detergent product, fibrous materials may be contacted with concentrated aqueous solutions, suspensions or pastes of the colored detergent and, even in the cases wherein the fibrous material is usually especially substantive to dyes, it will not be stained objectionably.

Among the materials which often are stained by regular dyes, perhaps the most difficult to avoid staining is wool. Other fibers which have caused staining problems include nylons, rayons, polyesters, acrylics and acetates. Additionally, various of the permanent press finished fibers have been found to be too readily dyed and when the dye is set on these materials, it is often difficult to remove. Although cotton may also be readily dyed by detergent coloring dyes, it may be more severely treated than the other materials to remove the coloration and therefore, because of its "bleachability", the staining problem is not as serious. Among the various materials against which the present fugitive dyes have been tested are polyesters, such as Dacron (R) and Fortrel (R); polyamides, such as nylon 6, nylon 66 and Caprolan (R); acrylics, including Acrilan (R), Creslan (R), Orlon (R), Zefran (R); Verel (R) and Dynel (R); and cellulosics, including acetates, triacetate, rayon and Avril (R). In all such cases the dye is fugitive and is readily removable by washing the fiber or fabric with a built detergent composition, such as those of the present invention. Some of the present dyes can discolor cotton materials under severe application conditions, at comparatively high concentrations, elevated temperatures and after exposures for long periods of time. However, in most cases the discoloration of cotton will not be sufficient to be objectionable and even in those instances wherein color is noticeably sorbed by the cotton it can be readily removed, either by washing in the detergent or by a stripping procedure. Such stripping may include the use of sodium chloride-acetic acid-sodium nitrate or sodium hydrosulfiteammonia stripping compositions in dilute solutions, e.g., 0.5 to 10 g./l., with heating for comparatively short periods of time, e.g., at 180°-212° F. for 10-30 minutes.

The detergent composition to be colored may be any suitable particulate product. Generally, the particles should be of sufficient size so as to make the coloration of a portion of the product stand out against a white background or other color of the rest of the material. Spray dried detergent beads, which are generally of globular form, are of desired particle size if the spray drying or classification process is regulated to produce spheres within the 6 to 200 mesh range, preferably in the 6 to 140 mesh range for the materials to be colored, and most preferably within the 8 to 100 mesh range. The densities of such particles, in bulk will often be from 0.2 to 0.6 g./cc. and are preferably from 0.3 to 0.5 g./cc. Of course, the use of the present fugitive dyes in detergent compositions is not limited to sprayed dried detergents but encompasses other suitable particulate materials of comparable particle sizes. Even liquid detergents can be very satisfactorily colored with the present fugitive dyes, as can cake or bar products. However, because the particulate detergent compositions, especially those which are highly or brightly colored, at least in part, present greater problems of dye transference when applied to laundry, e.g. shirt collars and cuffs, as a concentrated paste, and because the invention is most useful in such applications, these will be illustrated herein.

Spray drying of the base materials of a detergent composition is usually effected by crutching an aqueous crutcher mix or slurry comprising a synthetic organic detergent and inorganic builder or filler salts, with suitable adjuvants, and drying this in a stream of hot gas. The detergents most suitable for the practice of the present invention include the anionic and nonionic detergents, although in some cases, the ampholytic, amphoteric and zwitterion detergents may be employed, although usually in minor proportions. The anionic detergents include the higher alkyl benzene sulfonates, especially the water soluble salts of linear higher alkyl benzene sulfonates, e.g., the alkali metal salts thereof, of which sodium linear higher alkyl benzene sulfonate is preferred. However, other anionic detergents and nonionic detergents, usually in minor proportions, may also be used, with the nonionics being spray dried with the anionics if only a small proportion is to be employed but being sprayed onto the base detergent particles or otherwise post-mixed if more than about 2–5% of nonionic is to be present in the formula. The anionic detergents are well known in the art and are described at length at pages 25 to 138 of the text *Surface Active Agents and Detergents,* Vol. II, by Schwartz, Perry and Berch, published in 1958 by Interscience Publishers, Inc. Among the important anionic compounds so listed are the higher alkyl sulfates, the higher fatty acid monoglyceride sulfates, the higher olefin sulfonates, the higher alkyl sulfonates, the sulfated phenoxy polyoxyethanols, the branched higher alkyl benzene sulfonates and the higher fatty acid soaps. Usually, such compounds or derivatives are employed as water soluble salts and generally these are alkali metal salts, e.g., sodium salts, of the mentioned compounds. Also, the higher alkyl or fatty groups will generally be of 12 to 18 carbon atoms. Of the nonionic detergents, those are preferred which are hydroxyl-containing linear polymers of lower alkylene oxides. These include condensation products of higher fatty alcohols with polyoxy-lower alkylene glycols, such as Neodol 45-11, Plurafac B-26 and Alfonic 1618-65. Also useful are the block copolymers of propylene glycol, propylene oxide and ethylene oxide, such as the Pluronics®, e.g., Pluronic L-44, and the middle alkyl phenyl polyoxyethylene ethanols, such as those sold as Igepals®. It will be noted that the hydrophilic lower alkylene oxide chain is usually 5 to 20 units long attached to a more lipophilic group.

The linear higher alkyl benzene sulfonates will normally be of 12 to 15 carbon atoms in the alkyl groups, preferably of 13 or about 13 carbon atoms and the linear alkyl will be substantially terminally joined to the phenyl group. However, a minor proportion thereof may be joined to the 2- or 3-carbon but generally the amount thereof will be less than 30% and most of that will be joined on the 2-carbon. Although small quantities of such soluble sulfonates of metals other than sodium may be present, such metals normally will be minor proportions of the salt-forming metal. It will frequently be preferred to employ the sodium higher linear alkyl benzene sulfonate as the sole anionic detergent constituent of the base beads, since it is a good and acceptably biodegradable detergent, but it may sometimes be more desirable to mix it with other anionics for specific purposes. For example, small proportions of soap e.g., the sodium salt of an 80:20 or 85:15 tallow-coconut oil fatty acids mixture, may be present.

The greater part of the solids content of the crutcher mix is of inorganic salts, principally as builders or fillers for the detergent. An important builder salt constituent of this type is sodium silicate, although other alkali metal silicates may also be used. Of the sodium silicates which are employed, those having an $Na_2O:SiO_2$ ratio of from 1:1.6 to 1:3.4 are generally useful, either as the entire silicate content or a part thereof. Silicates of $Na_2O:SiO_2$ ratio of 1:2 to 1:3 are preferred. These silicates have building properties, add desired alkalinity, are anti-corrosive and are suitable for producing good crutcher mixes and stronger detergent beads. Other useful builders include pentasodium tripolyphosphate and tetrasodium pyrophosphate, well known heavy duty detergent builders. Trisodium nitrilotriacetate is a good builder, if environmetally acceptable. Additional compounds which serve as builders, are borax, sodium carbonate, sodium bicarbonate and sodium sesquicarbonate. A good filler salt is anhydrous sodium sulfate and sodium chloride may sometimes also be employed.

Various other constituents and adjuvants may be present in the crutcher mix or may be post-added, including sanitizers, e.g., trichlorocarbanilide, foam improvers, foam depressants, fungicides, anti-oxidants, stabilizers, chelating agents, optical bleaches or fluorescent brighteners, soil suspending agents and soil anti-redeposition agents. The anti-redeposition agents include natural and synthetic organic gums or resinous materials which aid in maintaining the removed soil and other constituents of a detergent wash water in suspension so that they are not deposited on the laundry as the rinse water is drained through it. Such compounds include sodium carboxymethyl cellulose, polyvinyl pyrrolidone, polyacrylic acid salts, polyacrylamide, polyvinyl alcohol and similar agents known in the art. The fluorescent brighteners help to whiten or brighten the detergent beads, making contrasts between colored beads and background more effective. The fluorescent brighteners are members of a wellknown class in the detergent art and usually are reaction products of cyanuric chloride and the disodium salt of diamino stilbene disulfonic acid, benzidine sulfone disulfonic acid, amino coumarins, diphenyl pyrazoline derivatives or naphthotriazolyl stilbenes. Such materials are described in the article *Optical Brighteners and Their Evaluation* by Per S. Stensby, a reprint of articles published in *Soap and Chemical Specialties* in April, May, July, August and September, 1967, especially at pages 3-5 thereof.

The fugitive dyes or tints which have been found to be specially useful as non-staining in uses of the present detergent composition, even when applied in concentrated solutions or pastes to any of the fibrous substrates to which dyes normally are most substantive, are those containing comparatively long polymeric chains of lower alkoxy groups, terminated by hydrogens. Such groups add water solubility and hydrophilic properties to the product, and make it similar to some detergents in action, promoting quick release of the dye. Although single polyalkoxy chain compounds may make satisfactory dyes, it is important for best action that there be plurality of such chains on the compound, joined through nitrogen to an aromatic group. Such a solubilizing group is then joined to an azo dye group and a portion of the dye molecule is sulfonated, again to improve the solubility, surface activity and fugitive nature of the tint. Various useful fugitive dyes for the present detergent compositions are described in U.S. Pat. Nos. 3,154,534; 3,154,535; and 3,157,633. Dyes within the descriptions are marketed under the trade name Versatints, by the Sylvan Chemical Division of Deering Miiliken, Inc. The dyes are described in technical bulletins issued by that company but are suggested only for use in the temporary dying of fibers and textiles. The described dyes may be diluted with water or other of the normal solvents, e.g., ethanol, isopropanol, methanol, acetone and lower diols or polyols, e.g., propylene glycol.

Of the dyes mentioned in the patents as being usefully fugitive on textiles, found to be satisfactory in the practice of the present invention are those of the formula

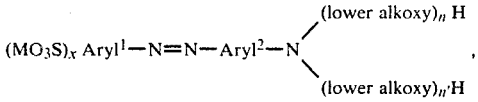

wherein M is a salt forming cation, the aryl groups are carbocylic and contain from 6 to 10 carbon atoms in the ring(s), x is from 1 to 4 and n and n' are from 15 to 75. To obtain desired colors, mixtures of the dyes may be employed. It is within the invention to utilize mixtures of the present fugitive dyes with others of less fugitive nature, providing that the final product is satisfactorily fugitive in the applications described. The fugitive dyes may be employed for coloring a minor proportion, e.g., 0.1 to 20% of the detergent composition or they may be used to color an entire composition. Different fugitive dyes may be employed so that different colored particles result.

The dye's contents of poly-lower alkoxy chains, in which the lower alkoxy is of 2 to 4 carbon atoms, will be chosen so as to improve the fugitive character of the dye. Thus, it will be preferred to employ polyethoxy chains but polypropoxy and polybutoxy components may be present in these chains, providing that they do not detrimentally diminish solubility and the fugitive nature of the tint. The azo dye portion of the molecule will have 1 to 4 sulfonic acid salt groups present, usually 1 to 3 and most often no more than two such groups. The salt forming ion is preferably an alkali metal but may be ammonium, lower alkanolammonium, di-lower alkanolammonium or tri-lower alkanolammonium, wherein the alkanol is of 1 to 4 carbon atoms, preferably of two carbon atoms. Additionally, suitable di- and tri-valent metals, e.g., magnesium, may be employed, providing that they do not adversely affect solubility or the fugitive properties of the dye. In general, however, the presence of divalent and polyvalent metal ions will be avoided, insofar as is possible, and it is a feature of the present invention that the hardness ions in water, which might normally adversely affect the fugitive nature of these tints, are prevented from reacting on the dyes by the presence of complex forming materials, such as sequestrants and builder salts, e.g., pentasodium tripolyphosphate, tetrasodium pyrophosphate, sodium sesquisilicate, sodium metasilicate, NTA and EDTA.

The aryl groups of both the azo dye and substituted aromatic amine portions of the fugitive tint molecules are preferably either naphthalene or benzene or substituted derivatives thereof in which the substituents are lower alkyl, lower alkoxy, amino, hydroxyl or nitro. The lower alkyls and alkoxies are preferably of 1 to 4 carbon atoms, most usually of 1 to 2 carbon atoms. With respect to the aromatic amine portion of the dye, it is preferred that the aromatic ring be a benzene ring and that substitution be by lower alkyl or lower alkoxy, preferably by methyl or by no substituent at all. With respect to the azo dye portion of the molecule, various of the mentioned substituents can be present and the aryl group will usually be benzene or naphthalene.

The following are examples of the useful dyes which may be employed:

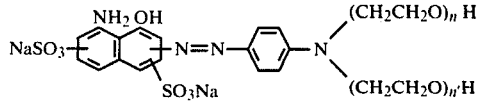

(I)

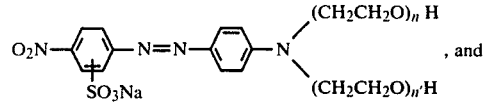

(II)

, and

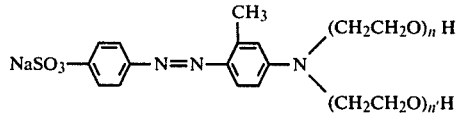

(III)

In the above formulas, that designated (I) is of a blue color and is preferred when the $NaSO_3$ groups are located meta to the amino and hydroxyl radicals. (II) is a red fugitive tint and (III) is yellow. The preferred green is a mixture of (I) and (III).

Virtually unlimited mixtures of these dyes may be made to produce a wide variety of colors, according to known techniques.

The types of detergents, builders, adjuvants and other materials present in the detergent preparations will be chosen so that the final detergent product, including the fugitive dye(s), will have a pH in a 0.1% aqueous solution in the range of about 5 to 11, preferably 6 to 10. Such a range is that in which the fugitive dyes are most stable. Of course, the pH may be somewhat higher at higher concentrations of the detergent present in concentrated aqueous solutions or pastes but this does not interfere with the fugitive nature of the dye in such applications because minor color changes in the dye are usually not objectionable when the detergent is being employed to scrub dirt or stains out of materials to be laundered. The presence of polyvinyl alcohol or another poloymeric coating material on the surface of the detergent particles with the fugitive dye assists in protecting the dye against a higher alkalinity on the detergent bead surface when the dye is applied, as by spraying from an aqueous solution, and when the detergent is used. Thus, better reproducibility of colors is obtainable when such a coating composition is employed. The coating composition also helps to protect the dye against oxidation or other chemical reactions with materials in the air or in the detergent beads. Such protection is improved if the moisture content of the bead is held to less than 15% and preferably it is from about 2 to 13% during storage. The dyes are also resistant to oxidation themselves, and can be used in perborate-containing preparations without being degraded.

The proportions of materials employed in the detergent compositions may be varied, as is known in the art, to obtain best cleansing effects. Usually, the total proportion of synthetic organic detergent (for convenience, such term also includes fatty acid soaps) will be from 5 to 30% and the builder salt content will be from 10 to 50%. If nonionic detergent is present it will normally comprise from 1 to 10% of the product. Preferably, the sodium higher linear alkyl (of 12 to 15 carbon atoms) aryl sulfonate detergent will be present to the extent of 5 to 15% and the polyethoxy ethanol will be 1 to 5% of the product. Sodium soap is preferred to be present to the extent of 0.5 to 3%. It adds cleaning power and diminishes foaming. Also, in the preferred compositions there is present 10 to 40% of sodium tripolyphosphate, more preferably from 20 to 45% thereof, 5 to 15% of sodium silicate and 20 to 40% of sodium sulfate. The organic polymeric coating material applied to the colored beads with the fugitive dye will normally be polyacrylic acid, polyacrylamide or polyvinyl alcohol and will be from 0.01 to 1% of the product, with the dye being from 0.001 to 0.1%, under normal conditions.

In preferred embodiments of the invention, the colored particles, which, other than for their content of dye, may be of the same composition as the rest of the particles, will be of particle size in the 6 to 140 mesh range, preferably from 8 to 100 mesh. At least, 80% of the particles of the total product should be in the 6 to 200 mesh range and preferably, all of the particles will be in this range. The colored detergent particles need not be spray dried and can be of somewhat irregular shapes, as in the cases of prills and granules. Instead of coloring the particles themselves, suitable builders or fillers may be colored or a portion of these may be dyed. Generally, it is preferable to color a portion of the sodium tripolyphosphate builder component of the compositions but other builders and fillers, e.g., sodium sulfate, tetrasodium pyrophosphate, sodium carbonate, borax, may be colored or portions of these may be dyed. With the dye one may employ non-fugitive dyes or even water dispersible pigments but it will be evident that the use of such materials diminishes the fugitive nature of the colorant. When a plurality of colored particles is utilized a miniumum content of each is 0.05%, by weight. Preferably, from 0.3 to 5% , more preferably 0.5 to 3% of colored particles will be present in mixed color preparations. For good contrast, such colored particles will usually be highly colored with strong chroma and hues and low values. Yet, in those cases where pastel shades are desired, they may be employed. Normally, however, when pastels are used it will be for coloring a major proportion of the detergent compositions.

The following is a brief description of the method of manufacture of the present product, as a speckled or mixed-color detergent;

For the manufacture of the present compositions an aqueous crutcher mix, slurry or suspension of heat-resistant components of the detergent is made, generally with from 30 to 60% water content, is dried by conventional spray drying methods, using a heated gas, usually at a temperature of 350° to 800° F., is colored with the present fugitive dyes, preferably by spraying onto the surface of a portion of the product or onto a portion of a component builder salt thereof, and subsequently has adjuvants, such as perfume, sprayed onto the product. The colored and uncolored portions of the product may be blended before or after final additions of materials such as perfume, but it is preferred that the blending be effected simultaneously with perfume addition. If desired, maufacture may be by dry blending, drum drying, agglomerating or other production techniques, instead of spray drying. Also, the fugitive color may be crutched in with the detergent mix so as to have it throughout the beads, but this is usually not preferred.

A crutcher formula of synthetic organic detergent, builder, filler and adjuvant materials is made comprising water, linear tridecyl benzene sulfonate slurry, sodium silicate, anhydrous sodium sulfate, nonionic detergent, e.g., Plurafac B-26, anti-redeposition agent, e.g., sodium carboxymethyl cellulose, polyvinyl alcohol, fluorescent brightener, sodium higher fatty acid soap, preservative and builder, e.g., pentasodium tripolyphosphate. This is crutched at an elevated temperature e.g., 130° to 180° F. for a sufficient period to disperse the ingredients satisfactorily, after which it is spray dried in a conventional countercurrent spray drying tower.

Finally, while the uncolored detergent base material, is being dried, a dye solution is being made and sprayed onto the outer surfaces of particles of sodium tripolyphosphate builder. The dye solution is made by dissolving a polymeric coating material, e.g., polyvinyl alcohol, in warm water (120°-140° F.), dissolving a fugitive dye of the present invention in propylene glycol or similar lower monohydric, dihydric or trihydric alcohol (which also acts as a plasticizer for the polymeric coating gum or resin), mixing the two solutions together and spraying them onto the STPP, which is of light density granular grade, and of 8 to 100 mesh. The dye solution, as supplied by the manufacturer, is usually of 5 to 40% concentration and preferably will be 15 to 30%, in an aqueous medium, which may include lower alkanol. The dye solution, with coating polymer, is then sprayed onto the builder and, keeping the particles in motion, is distributed at the surface of the builder to color them, while not penetrating to the interiors thereof, largely because of the presence of the coating composition with the dye. Thus, the minimum amount of dye is employed to obtain excellent surface dyeing effects.

It is now a simple matter to blend the colored particles and the detergent base material, as desired, to obtain the best aesthetic and identification effects.

The following examples illustrate the invention but do not limit it. Unless otherwise indicated, all parts are by weight and all temperatures are in °F.

| EXAMPLES | Parts |
|---|---|
| Sodium linear higher alkyl ($C_{12-15}$) benzene sulfonate | 12.0 |
| Nonionic Detergent (Plurafac B-26) | 2.0 |
| Pentasodium tripolyphosphate | 32.5 |
| Sodium Silicate ($Na_2O$: $SiO_2$ ratio of 1:2.35) | 7.0 |
| Sodium carboxymethyl cellulose | 0.5 |
| Polyvinyl alcohol | 0.06 |
| Sodium sulfate | 32.0 |
| Fluorescent brighteners | 1.13 |
| Sodium coconut-tallow 20:80 soap | 1.0 |
| Preservative | 0.01 |
| Polar Brilliant Blue Dye RAW (Geigy) | 0.001 |
| Versatint Green LF Solution Fugitive Dye (Sylvan) | 0.002 |
| Moisture | 11.0 |

The heavy duty speckled detergent of the above formula contains 0.5% each of blue tinted and fugitive green tinted TPP granules mixed in with the other white detergent base. The pH (1% solution) is 10.0±0.4 and the product is an excellent low sudsing detergent powder. The colored particles stand out in the mix, making the product readily identifiable and improving its appearance. Yet, the green dye is not held by textiles of wool, polyester, acrylic, rayon or nylon or permanent pressed materials. Any color that is held by cotton is readily removed by washing with the detergent. Although the blue dye is not so held by the textiles as to be a stain on them, it is the green dyes that have given most trouble in this respect and the present fugitive dye avoids the problem.

Manufacture of the described products is comparatively simple. First, the TPP granules on which the dyes are to be coated are removed from the formula amounts of TPP to be otherwise employed in the spray drying. Then, all the ingredients except the dyes, propylene glycol carrier, water for the polyvinyl alcohol and the polyvinyl alcohol are blended together in the crutcher, at elevated temperature, and are spray dried, removing about $\frac{3}{4}$ of the water of the mix. The beads resulting are substantially all of particle sizes within the 6 to 200 mesh range. The 6 to 100 mesh or in some cases, 6 to 140 mesh STPP particles are placed in a tumbling drum and have the dyes sprayed onto them, preferably using a nozzle small enough so that the spray is small particle dominated and falls on the granules in a near dry condition, minimizing penetrations into the granules. The dye solution may contain from 1 to 10% dye solids, 10 to 30% PVA, 10 to 20% propylene glycol and the balance water, for best spray results. After tumbling until all the particles of TPP are coated, they are blended with the other detergent particles and perfume is added, after which the product is packed and is ready for use.

Variations of the formula are made and tested against various substrates and the green dye is found to be fugitive, even when applied in hot or cold water, as a concentrated solution or paste. Similar results obtain when only the green dye is used and when 10% of the particles are colored with it and corresponding properties are typical of the other of the mentioned class of fugitive dyes of this invention. Also, when the detergent contains NTA in total replacement of the TPP and when the silicate is increased to 12% at the expense of the sodium sulfate, the same results are obtained. When the anionic detergent is replaced with sodium lauryl sulfate and when the nonionic is nonyl pheny polyoxyethylene ethanol there is no difference in the successful fugitivity of the dyes. However, the results are not as good when the polyvinyl alcohol or other coating agent is omitted from the spray dye formula and more dye is required for the same degree of coloration.

The invention has been described with respect to specific working examples and a specification of preferred embodiments but is not to be limited thereto, since it is apparent that equivalents may be substituted and modifications made without departing from the spirit of the invention and the present teachings.

What is claimed is:

1. A multi-colored, particulate detergent composition consisting essentially of from 5 to 30% of a synthetic organic detergent selected from the group consisting of anionic detergents and nonionic detergents and mixtures thereof, from 10 to 50% of a detergent builder salt with over 80% of the particles of said composition in the 6 to 200 mesh range, and 2–13% water the colored particulate component of the composition consisting essentially of builder salt constituting from 0.1 to 20% of the composition and being substantially in the 6 to 140 mesh range, with the color of said colored particulate component being provided by a coating of a fugitive dye or mixture of such dyes of the formula selected from the group

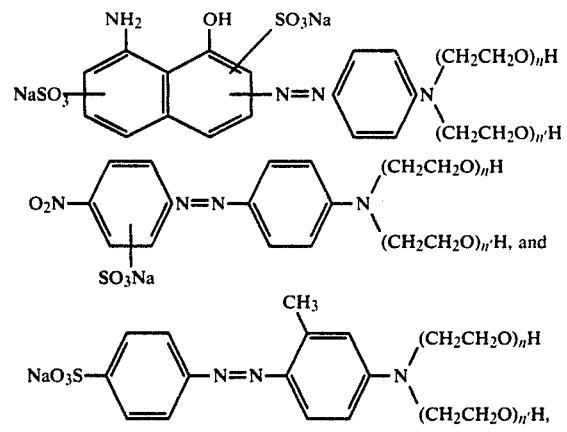

wherein n and n' are from 15 to 75, the composition having a pH in a 0.1% aqueous solution in the range of 6 to 10, said coating including a polymeric material selected from the group consisting of polyvinyl alcohol, polyvinyl pyrrolidone, polyacrylic acid salts, sodium carboxymethyl cellulose and polyacrylamide, said fugitive dye comprising from 0.001 to 0.1% by weight of said composition and said polymeric material comprising from 0.01 to 1.0% by weight of said composition.

2. A detergent composition according to claim 1 wherein said builder salt is selected from the group consisting of sodium silicate, pentasodium tripolyphosphate, tetrasodium pyrophosphate, trisodium nitrilotriacetate, EDTA, borax, sodium carbonate, sodium bicarbonate and sodium sesquicarbonate.

3. A detergent composition according to claim 2 consisting essentially of anionic and nonionic synthetic organic detergents and builder salt, with the anionic detergent being selected from the group consisting of linear higher alkyl benzene sulfonates, higher alkyl sulfates, higher fatty acid monoglyceride sulfates, higher olefin sulfonates, higher alkyl sulfonates, sulfated phenoxy polyoxyethanols, and higher fatty acid soaps wherein the higher alkyl and higher fatty groups are of 12 to 18 carbon atoms, the anionic detergent is present as an alkali metal salt and the polyoxyethanol includes from 5 to 20 ethoxy groups, the nonionic detergents are selected from the group consisting of condensation products of higher fatty alcohols with polyoxylower alkylene glycols, block copolymers of propylene glycol, propylene oxide and ethylene oxide and middle alkyl phenyl polyoxyethylene ethanols wherein the higher fatty groups are of 12 to 18 carbon atoms and the lower akylene oxide chain is 5 to 20 units long, and inorganic builder salt, with the total proportion of synthetic organic detergent being from 5 to 30% and that of inorganic builder salts being from 10 to 50%.

4. A detergent composition according to claim 3 wherein the anionic detergent is a sodium $C_{12}$ to $C_{15}$ linear alkyl benzene sulfonate and the nonionic is a $C_{12}$ to $C_{18}$ fatty alcohol polyethoxy ethanol in proportions of 5 to 15% of anionic detergent and 1 to 5% nonionic detergent, and the builder salts comprise 10 to 35% sodium tripolyphosphate, 5 to 15% sodium silicate and 20 to 40% sodium sulfate.

* * * * *